US008857135B2

(12) United States Patent
Yasunaga et al.

(10) Patent No.: US 8,857,135 B2
(45) Date of Patent: Oct. 14, 2014

(54) MEDICINE PACKAGING DEVICE AND CART FOR CHANGING PACKAGING UNIT

(75) Inventors: Itsuo Yasunaga, Toyonaka (JP); Chisei Asaoka, Toyonaka (JP); Norifumi Oike, Toyonaka (JP); Kensuke Kaminishi, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 965 days.

(21) Appl. No.: 13/001,388

(22) PCT Filed: Jun. 25, 2009

(86) PCT No.: PCT/JP2009/061577

§ 371 (c)(1),
(2), (4) Date: Dec. 23, 2010

(87) PCT Pub. No.: WO2010/001799

PCT Pub. Date: Jan. 7, 2010

(65) Prior Publication Data

US 2011/0107591 A1 May 12, 2011

(30) Foreign Application Priority Data

Jun. 30, 2008 (JP) ..... 2008-170884

(51) Int. Cl.

| | |
|---|---|
| ***B65B 43/04*** | (2006.01) |
| ***B65B 9/06*** | (2012.01) |
| ***B65B 59/04*** | (2006.01) |
| ***G07F 17/00*** | (2006.01) |
| ***G07F 11/00*** | (2006.01) |
| *B65B 61/02* | (2006.01) |

(52) U.S. Cl.

CPC ..... *B65B 59/04* (2013.01); *B65B 61/025* (2013.01); *B65B 9/06* (2013.01); *G07F 17/0092* (2013.01); *G07F 11/007* (2013.01)

USPC ..... 53/562; 53/247; 53/558; 53/568

(58) Field of Classification Search

CPC ..... G07F 17/0092; B65B 37/00; B65B 37/08; B65B 5/103; A61J 7/0084

USPC ..... 53/558, 562, 247, 568

See application file for complete search history.

(56) References Cited

U.S. PATENT DOCUMENTS 5,819,500 A * 10/1998 Haraguchi et al. ..... 53/154
5,940,953 A 8/1999 Arends et al.

(Continued)

FOREIGN PATENT DOCUMENTS

EP 1598275 A1 5/2004
EP 1489000 A1 12/2004

(Continued)

OTHER PUBLICATIONS

Extended European Search Report for EP 09773377.8-2308, 5 pages, mailed Jun. 8, 2011.

*Primary Examiner* — Gloria R Weeks
(74) *Attorney, Agent, or Firm* — Jones Day

(57) ABSTRACT

There is provided a medicine packaging device that can resolve the problem in which fine mechanical adjustments are needed for changing setting conditions of a packaging part or when the packaging part fails. The medicine packaging device has a device body 3 having an accommodation space 5, a slide unit 8 reciprocally attached to the accommodation space 5 of the device body 3, and a packaging unit 4 removably attached to the slide unit 8. The packaging unit is allowed to package medicines with a package paper 23 by moving the slide unit 8 a packaging position in the accommodation space 5. The packaging unit is moved to a drawn-out position drawn out from the packaging position. The packaging unit is replaceable by being moved to a replacement position drawn out from the device body 3.

6 Claims, 11 Drawing Sheets

(56) References Cited

U.S. PATENT DOCUMENTS

| | | | | |
|---|---|---|---|---|
| 6,726,056 | B2 * | 4/2004 | Yuyama et al. | 221/124 |
| 6,751,926 | B1 * | 6/2004 | Cooper | 53/79 |
| 7,293,672 | B2 * | 11/2007 | Mori et al. | 221/122 |
| 7,596,925 | B2 | 10/2009 | Yuyama et al. | |
| 7,637,078 | B2 * | 12/2009 | Ishiwatari et al. | 53/52 |
| 8,028,504 | B2 * | 10/2011 | Zeller et al. | 53/559 |
| 8,167,008 | B2 * | 5/2012 | Taniguchi et al. | 141/281 |
| 8,661,771 | B2 * | 3/2014 | Kodama | 53/373.7 |
| 2002/0152717 | A1 * | 10/2002 | Yuyama et al. | 53/238 |
| 2004/0261357 | A1 * | 12/2004 | Takahashi et al. | 53/247 |
| 2006/0160684 | A1 | 7/2006 | Springston et al. | |
| 2007/0016327 | A1 * | 1/2007 | Yuyama et al. | 700/231 |
| 2008/0163588 | A1 * | 7/2008 | Kim | 53/131.5 |
| 2010/0229506 | A1 * | 9/2010 | Kumano | 53/493 |
| 2011/0107591 | A1 * | 5/2011 | Yasunaga et al. | 29/700 |
| 2011/0126489 | A1 * | 6/2011 | Kodama | 53/374.4 |
| 2012/0159908 | A1 * | 6/2012 | Hatsuno et al. | 53/558 |

FOREIGN PATENT DOCUMENTS

| | | |
|---|---|---|
| JP | 9-123805 | 5/1997 |
| JP | 2004-284656 | 10/2004 |
| JP | 2006-130307 | 5/2006 |
| WO | WO 2007/113664 A2 | 10/2007 |

* cited by examiner (a)

(b)

(c)

(a)

(b)

(c)

MEDICINE PACKAGING DEVICE AND CART FOR CHANGING PACKAGING UNIT

CROSS-REFERENCE TO RELATED APPLICATIONS

This application is a 35 U.S.C §371 national stage filling of International Application No. PCT/JP2009/061577, filed Jun. 25, 2009, the entire contents of which are incorporated by reference herein, which claims priority to Japanese Patent Application No. 2008-170884, filed Jun. 30, 2008, the entire contents of which are incorporated by reference herein.

TECHNICAL FIELD

The present invention relates to a medicine packaging device. Further, the present invention relates to a cart for replacing a packaging unit for use in such a medicine packaging device.

BACKGROUND ART

There exists in the art a medicine packaging device including a device body, a medicine accommodating and dispensing part and a packaging part, wherein the packaging part includes many drive systems such as a printing part, a sealing part, a conveyor, etc. that are configured to be electrically connected to the device body (see, e.g., Patent Document 1).

Patent Document 1: Japanese Laid-Open Patent Application No. 2006-130307

However, when changing setting conditions of a drive system due to change in type of a packaging paper in a packaging part, the aforesaid medicine packaging device needs fine mechanical adjustments, all of which cannot be handled by means of a software. Such a task cannot be readily performed. Further, when the packaging part fails, repairing the packaging part takes a significant amount of time and the packaging operation must stop during such repair.

Thus, it is an object of the present invention to provide a medicine packaging device and a cart for replacing a packaging unit, which can resolve the above-described situation wherein fine mechanical adjustments are needed due to changing setting conditions of the packaging part or when the packaging part fails.

SUMMARY OF THE INVENTION

As measures for solving the foregoing problems, the present invention provides a medicine packaging device comprising: a device body having an accommodation space; a slide unit reciprocally attached to the accommodation space of the device body; and a packaging unit removably attached to the slide unit, the packaging unit being allowed to package medicines with a packaging paper by moving the slide unit to a packaging position in the accommodation space. The packaging unit is moved to a drawn-out position drawn out from the packaging position. The packaging unit is replaceable by being moved to a replacement position drawn out from the device body.

According to such construction, a task of replacing the packaging unit can be easily performed with a simple construction wherein the slide unit is drawn out from the accommodation space of the device body frontward of the device body and then the packaging unit is moved from the packaging position to the replacement position.

It is preferred that the packaging unit is supported so as to be pivoted between the drawn-out position and the replacement position relative to the slide unit.

According to such construction, the packaging unit can be easily replaced only by pivoting the packaging unit to the replacement position relative to the slide unit. Since the packaging unit is pivoted, movement from the drawn-out position to the replacement position does not need so much strength and thus can be easily done.

It is preferred that the slide unit includes a bearing part with a cutout portion and the packaging unit includes a shaft member. It is preferred that the shaft member is cut with a width dimension permitting the shaft member to be inserted into the bearing part through the cutout portion in the replacement position. After insertion, the shaft member is not permitted to separate as an outer peripheral surface thereof is rotatably supported by rotating the shaft member to a position other than the replacement position.

As such, the packaging unit is attachable to and detachable from the slide unit through a very simple construction including the bearing part and the shaft member. Thus, the replacement task for the packaging unit can be simply performed.

It is preferred that the shaft member includes a shaft section integrated to the packaging unit and an anti-separation section rotatable relative to the shaft section. It is preferred that when the packaging unit is pivoted from the drawn-out position to the replacement position, the shaft section is attachable to and detachable from the bearing part through the cutout portion and the anti-separation section remains held in the bearing part. It is preferred that the shaft member is attachable to and detachable from the bearing part through the cutout portion by separately rotating the anti-separation section.

According to such construction, there is no problem associated with the packaging unit being pivoted to the replacement position and then unintentionally falling off. This provides an excellent safety.

It is preferred that the anti-separation section is integrated to a bent plate provided in an upper end of the shaft section and extending laterally and further downwardly. It is preferred that a stopper part is integrated to a lower end of the bent plate. It is further preferred that the stopper part prevents separation from the bearing part by contacting a placing part of a cart and hindering pivoting to hinder a rotation of the anti-separation section. The cart places the packaging unit separated from the slide unit thereon.

According to such construction, only when the packaging unit is pivoted and then moved to the cart having the placing part contacting to the stopper part, the packaging unit can be separated from the slide unit. Thus, the replacement work can be smoothly and safely performed. Furthermore, when performing a maintenance work without replacing the packaging unit, such maintenance work can be performed when the packaging unit is moved to the drawn-out position or the replacement position, thereby providing convenience.

Further, the packaging unit may include: an attaching member; a packaging roll removably attached to the attaching member, the packaging roll comprising a packaging paper wound therearound; a sealing part attached to the attaching member, the sealing part placing medicines into the packaging paper unwound from the packaging roll and sealing the packaging paper to package the medicines.

Further, as measures for solving the foregoing problems, the present invention provides a cart for replacing a packaging unit for use in a medicine packaging device. The medicine packaging device comprises: a device body having an accommodation space at a lower portion; a slide unit attached to the accommodation space of the device body to be slidable in frontward and rearward directions; and a packaging unit removably attached to the slide unit, the packaging unit being allowed to package medicines with a packaging paper by moving the slide unit to a packaging position rearward of the device body, the packaging unit being moved to a drawn-out position frontward of the device body, the packaging unit being replaceable by being moved to a replacement position drawn out frontward from the device body. The cart comprises a loading table having a placement surface located substantially at the same height as a bottom surface constituting the accommodation space of the device body. The loading table includes: a positioning part relative to the device body; and a placing part. The packaging unit is placed on the placing part by drawing out the slide unit to the drawn-out position and moving the packaging unit from the drawn-out position to the replacement position as positioned by the positioning part.

It is preferred that the slide unit includes a bearing part with a cutout portion and the packaging unit includes a shaft member. It is preferred that the shaft member is cut with a width dimension permitting the shaft member to be inserted into the bearing part through the cutout portion in the replacement position. After insertion, the shaft member is not permitted to separate as an outer peripheral surface thereof is rotatably supported by the rotating the shaft member to a position other than the replacement position. It is preferred that the shaft member includes a shaft section integrated to the packaging unit and an anti-separation section rotatable relative to the shaft section. It is also preferred that the anti-separation section is integrated to a bent plate provided in an upper end of the shaft section and extending laterally and further downwardly. It is preferred that a stopper part is integrated to a lower end of the bent plate. It is preferred that the stopper part prevents separation from the bearing part by contacting the placing part of the loading table and hindering pivoting to hinder a rotation of the anti-separation section. The loading table places the packaging unit separated from the slide unit thereon.

According to the present invention, a packaging part is constructed as a packaging unit in advance and can be detached from the device body. Thus, if a plurality of packaging units are prepared for each of the setting conditions, then it is possible to easily cope with the changes in the setting conditions. Further, even when the packaging unit fails, such packaging unit may be replaced with a spare packaging unit, thereby allowing rapid repair works. Further, since a pivot mechanism and a cart are used, the heavy packaging unit can be simply replaced with safety and reliability.

BRIEF DESCRIPTION OF THE DRAWINGS

FIG. 8(*b*) is a perspective view showing an engaging receptacle formed in the slide unit.

FIG. 8(*c*) is a perspective view showing an engaging member formed in the packaging unit.

DESCRIPTION OF REFERENCE NUMERALS

1 . . . Medicine Packaging Device, 2 . . . Cart, 3 . . . Device Body, 4 . . . Packaging Unit, 5 . . . Accommodation Space, 6 . . . Slide Base, 7 . . . Slide Rail, 8 . . . Slide Unit, 9 . . . Bottom Plate, 10 . . . Position Indicating Hole, 11 . . . Positioning Hole, 12 . . . Bottom Plate, 13 . . . Front Panel, 14 . . . Support Part, 15 . . . Support Plate, 16 . . . Engaging Receptacle, 17 . . . Rectangular Aperture, 18 . . . Operation Part, 19 . . . Connector Receptacle, 20 . . . Bearing Part, 21 . . . Cutout Portion, 22 . . . Attaching Member, 23 . . . Packaging Paper, 24 . . . Printing Part, 25 . . . Heat-sealing part, 26 . . . Hopper, 27 . . . Conveyor, 28 . . . First Plate, 29 . . . Rotating Shaft, 30 . . . Second Plate, 31 . . . Guide Roller, 32 . . . Shaft Member, 33 . . . Electric Wire Bundle, 34 . . . Larger-diameter Section, 35 . . . First Shaft Section, 36 . . . Anti-separation Section, 37 . . . Second Shaft Section, 38 . . . Bent Plate, 39 . . . Stopper Part, 40 . . . Relief Indentation, 41 . . . Attaching Piece, 42 . . . Spring, 43 . . . Connector, 45 . . . Engaging Claw, 46 . . . Engaging Member, 47 . . . Lever, 48 . . . Loading Table, 48*a* . . . First Lateral Edge, 48*b* . . . Second Lateral Edge, 48*c* . . . Aperture, 49 . . . Grip Part, 50 . . . First Placing Part, 50*a* . . . Indent, 51 . . . Second Placing part, 51*a* . . . Flat Portion, 51*b* . . . Ramp Portion, 52 . . . Third Placing Part, 52*a* . . . Flat Portion, 52*b* . . . Ramp Portion, 53 . . . Position Indicating Piece, 54 . . . Positioning pin, 55 . . . Operating Lever, 55*a*, 55*b* . . . Pedal, 56 . . . First Locking Lever, 57 . . . Second Locking Lever, 58 . . . Shaft

DETAILED DESCRIPTION

Embodiments of the present invention will be described with reference to the accompanying drawings. In the below description, the types, combinations, shapes, relative arrangement, etc. of elements or components are not intended to limit the scope of the present invention as described as such, unless specifically described. Further, where necessary, the terms (e.g., "upper," "lower," "one end," "opposite end," "frontward," "rearward," etc.) are appropriately used herein for indicating a particular direction or position. However, those terms used herein are for easy understanding of the present invention with reference to the drawings and are not intended to limit the scope of the present invention on their meanings.

(1. CONFIGURATION) FIGS. 1 to 4 show a medicine packaging device 1 and a cart 2 according to one embodiment. The medicine packaging device 1 is configured such that a packaging unit 4 is removably disposed in a device body 3.

Figure 1:
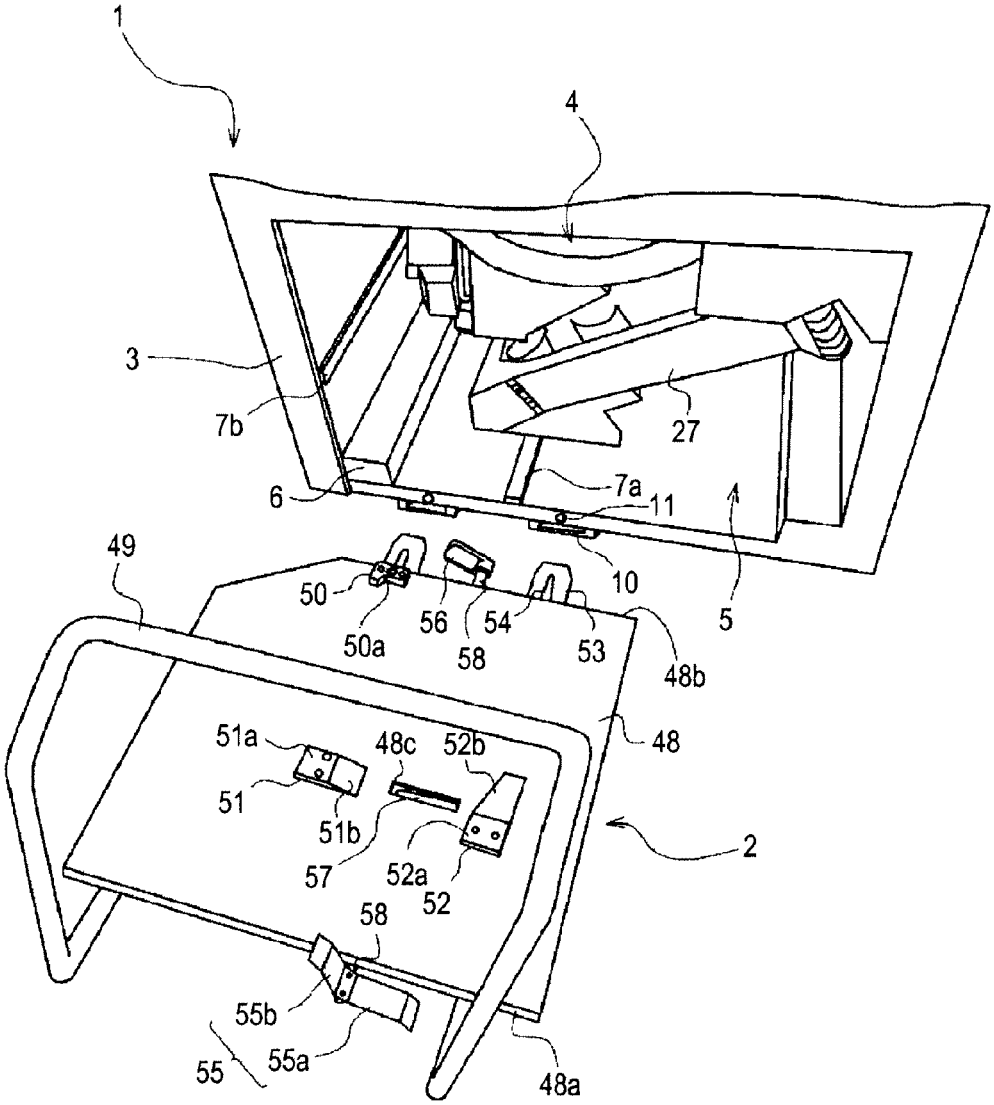
FIG. 1 is a perspective view showing a lower portion of a medicine packaging device according to one embodiment.

(1-1. Device Body 3) As shown in FIG. 1, a slide base 6 and a slide rail 7*a* are provided in an accommodation space 5 formed at a lower portion of the device body 3 in two places on a bottom surface. The slide base and the slide rail extend from the rear toward a front opening. The opening is closeable by a door (not shown). Further, a slide rail 7*b* is provided on a side surface. A position indicating hole 10 and a positioning hole 11 are formed in a front end surface of a bottom plate 9 of the device body 3 at a predetermined interval in a width direction. Each of the holes 10, 11 is used for positioning the cart 2 (the cart will be described below) with respect to the device body 3.

Figure 6:
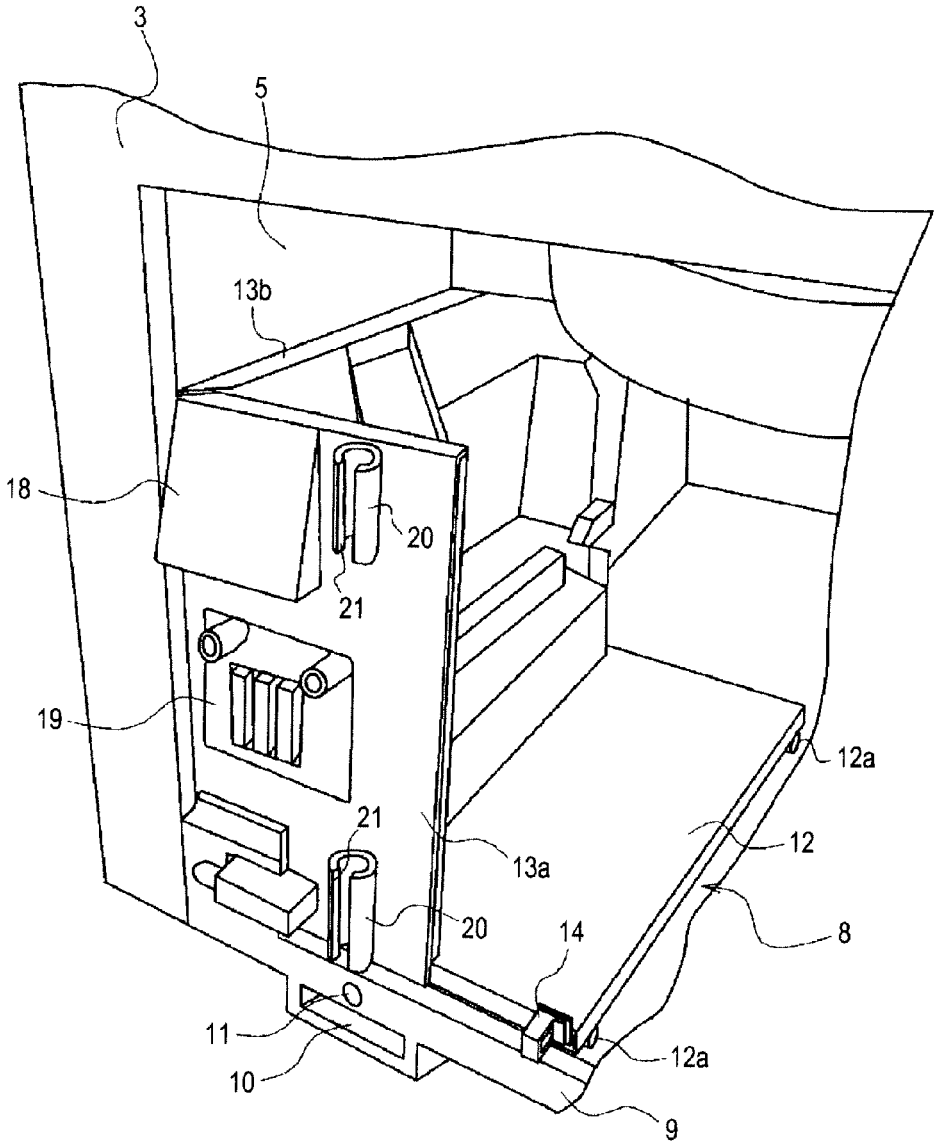
FIG. 6 is a perspective view wherein the packaging unit is removed (the slide unit is drawn out).
Figure 8:
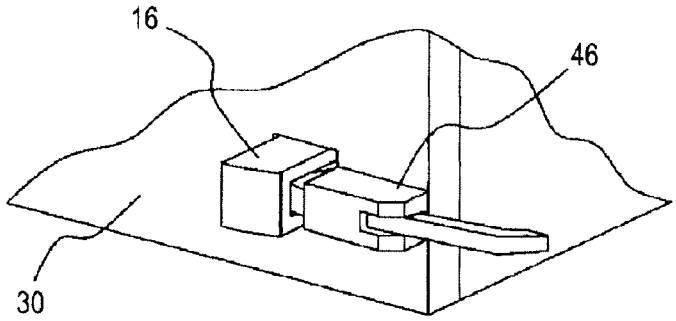
FIG. 8(*a*) is a perspective view showing a positioning mechanism between the packaging unit and the slide unit.
Figure 8:
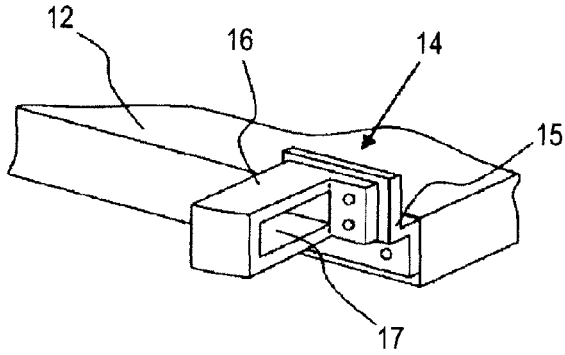
Figure 8:
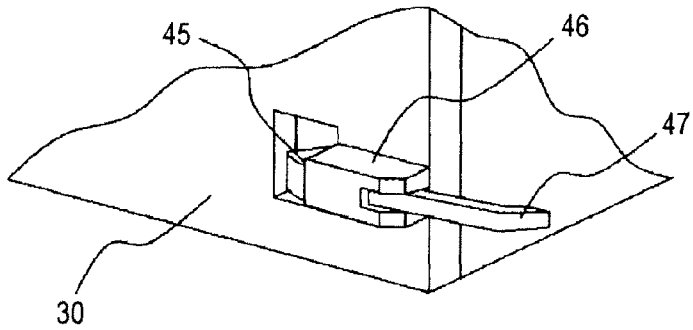
Figure 9:
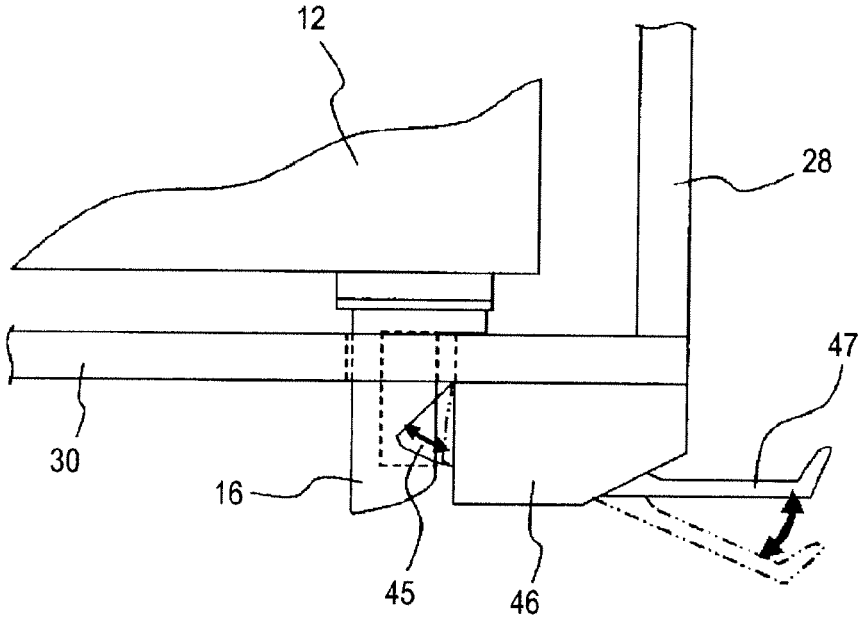
FIG. 9 is a plan view showing that positioning is done by the positioning mechanism of FIG. 8.
Figure 10:
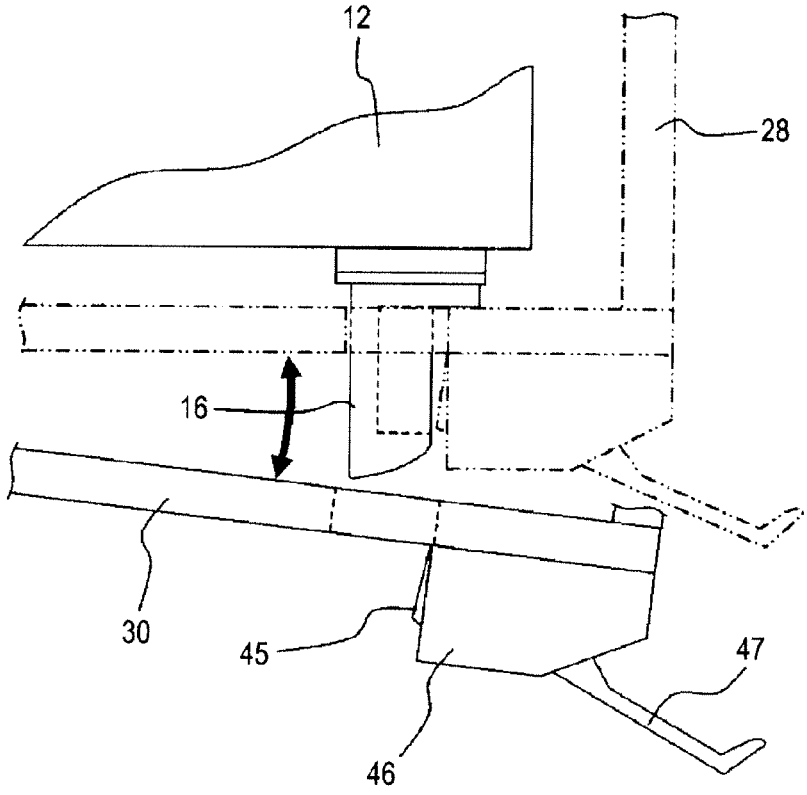
FIG. 10 is a plan view showing that positioning is released by the positioning mechanism of FIG. 8.

A slide unit 8 (see FIG. 6) is disposed above the slide base 6 and the slide rail 7*a*. As shown in FIG. 6, the slide unit 8 includes the following: a bottom plate 12; a front panel 13*a* erected from a half of a front edge of the bottom plate; and a side panel 13*b* adjoining the front panel 13*a* and being erected from a lateral edge of the bottom plate 12. The slide unit 8 is configured to reciprocate frontward and rearward, while the slide rail 7*a* guides the bottom plate and the slide rail 7*b* guides the side panel 13*b*. Rollers 12*a* rolling on a bottom surface of the accommodation space 5 of the device body 3 are provided in both lateral portions of a lower surface of the bottom plate 12 at frontward and rearward locations. The rollers 12*a* are provided to assist the slide rails 7*a*, 7*b*. Further, a support part 14 for the packaging unit 4 is provided in one end of a front end surface of the bottom plate 12. As shown in FIG. 8(*b*), the support part 14 includes a support plate 15 and an engaging receptacle 16. The support plate is fixed to the front end surface of the bottom plate 12 and has a crank shape. The engaging receptacle is fixed to an end surface of the support plate 15 protruding frontward. A rectangular aperture 17, to and from which an engaging claw 45 described below engages and disengages, is formed in the engaging receptacle 16. As shown in FIG. 6, an operation part 18, a connector receptacle 19 and bearing parts 20 are provided on a front surface of the front panel 13*a*.

The operation part 8 includes various types of buttons (not shown). A drive motor 5 (see FIG. 5), a heat-sealing part 26, etc. can be operated by operating the buttons. A connector 43 of the packaging unit 4 may be attached to and detached from the connector receptacle 19. By doing so, the packaging unit 4 is energized and can receive and transmit signals. The bearing parts 20, which are provided at two vertical locations, have a substantially C-shaped cross-section with a cutout portion 21 cut out from a front mediate portion thereof. The bearing parts 20 rotatably support a shaft member 32 of the packaging unit 4 described below.

(1-2. Packaging Unit 4) As shown in FIGS. 2 to 5, the packaging unit 4 includes the following: a substantially L-shaped attaching member 22; a packaging paper 23; a printing part 24 performing a predetermined printing work on the packaging paper 23; a heat-sealing part 25 heating the packaging paper 23 in part to form the packaging paper into a pack shape and packaging the same after placing medicines therein; a hopper 26 feeding medicines into the packaging paper 23 formed into the pack shape; and a conveyor 27 obliquely upwardly conveying the packaging paper 23 packaged with medicines.

The packaging paper 23 is removably mounted on a rotating shaft 29 protruding from a first plate 28 of the attaching member 22, as bifold and wound around a roll. The printing part 24 is attached to the first plate 28 adjacent to the packaging paper 23. The printing part 24 pushes a wound ink ribbon against the packaging paper 23 by means of a heated header and then performs a predetermined printing work on the packaging paper 23 based on a prescription data inputted from a host computer (not shown). The heat-sealing part 25 is attached to a second plate 30 of the attaching member 22. The heat-sealing part diverts a path of the packaging paper 23 through guide rollers 31 from a conveyance path running along the first plate 28 to a conveyance path running obliquely downwardly along the second plate 30 and then seals the packaging paper at predetermined intervals. Further, after medicines are accommodated in the packaging paper, the heat-sealing part packages the packaging paper by sealing a yet opened portion of the packaging paper. The hopper 26 receives medicines dispensed from medicine feeders (not shown). The hopper expands in an approximate V shape through a triangle plate. At a downstream of the hopper, the hopper feeds the medicines to the packaging paper 23 that is sealed by the heat-sealing part 25 and thus formed into a pack shape. The conveyor 27 is provided to convey the packaging paper 23 with the medicines packaged therein to an obliquely upward position where the users can easily take it out.

The shaft member 32, which is rotatably supported by the bearings 20 provided in the device body 3, is provided at a lateral edge of the second plate 30 of the attaching member 22. A drive motor is provided in the vicinity of the shaft member to operate the heat-sealing part 25 through a plurality of gears. Reference numeral 33 indicates an electric wire bundle gathering codes that are used for supplying electric power to the drive motor or transmitting signals. The electric wire bundle is connected to the connector 43 described below.

Figure 7:
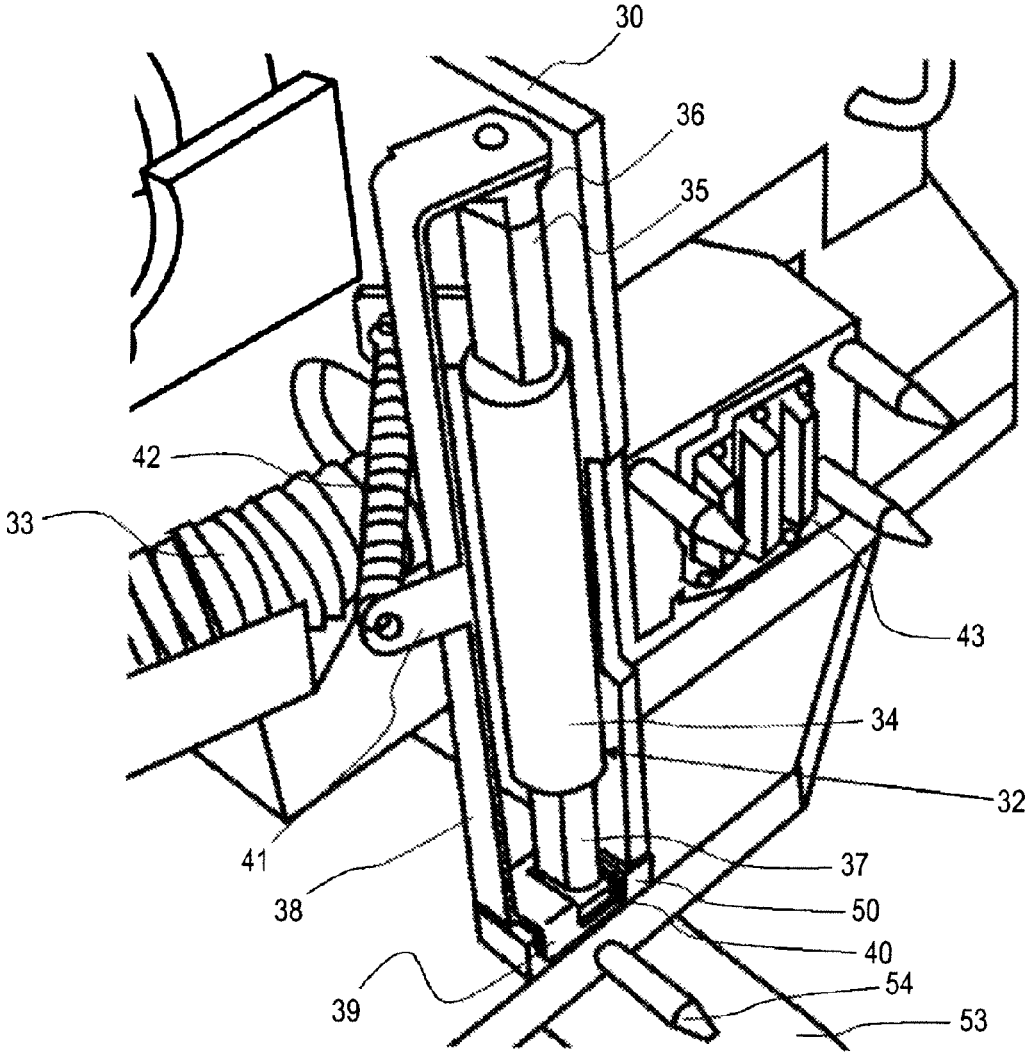
FIG. 7 is a partially enlarged view of FIG. 5.

As shown in FIG. 7, the shaft member 32 includes the following: a larger-diameter section 34 fixed to the second plate 30; a first shaft section 35 and an anti-separation section 36 formed at an upper end; and a second shaft section 37 formed at a lower end. The anti-separation section 36 is rotatably connected to an upper end of the first shaft section 35. Further, the anti-separation section is integrated to a bent plate 38.

The bent plate 38 protrudes laterally from the anti-separation section 36 and then extends downwardly alongside the shaft member 32. A stopper part 39 is formed at a lower portion of the bent plate. The stopper part 39 includes: a horizontal portion to be located near above a first placing part 50 of a loading table 48 described below; and a vertical portion bent from an edge of the horizontal portion at a right angle so as to be brought into contact with a lateral side of the first placing part 50. A relief indentation 40 is formed in the stopper part 39 throughout the horizontal portion and the vertical portion. A lower end surface of the second shaft section 37 can be placed on the first placing part 50 through the relief indentation 40. Further, an attaching piece 41 is provided at a midway of the bent plate 38. The attaching piece is coupled to an opposite end of a spring 42, one end of which is coupled to the second plate 30.

Cut surfaces are formed in the first shaft section 35, the anti-separation section 36 and the second shaft section 37. The cut surfaces are formed by cutting lateral sides of the first shaft section, the anti-separation section and the second shaft section parallel to the second plate 30. The cut surfaces allow the first shaft section 35, the anti-separation section 36 and the second shaft section 37 to be inserted through the cutout portion 21 from the front thereof. However, attaching and detaching the first shaft section 35 and the second shaft section 37 to and from the bearing part 20 through the cutout portion 21 are restricted to the cases satisfying the following two conditions. That is, the first case is that the packaging unit 4 is pivoted at about 90 degrees relative to the device body 3 and is then positioned in a replacement position. The second case is that placing the packaging unit 4 on the cart 2 in the replacement position positionally restricts the bent plate 38 by the first placing part 50 against a force of the spring 42. Positionally restricting the bent plate 38 makes the position of the cut surfaces of the anti-separation section 36 integrated to the bent plate coincide with the cut surfaces of the first shaft section 35 and the second shaft section 37. As a result, the shaft member 32 is permitted to attach to and detach from the bearing part. In a position other than the replacement position, outer peripheral surfaces of the first shaft section 35 and the second shaft section 37 are rotatably guided on an inner peripheral surface of the bearing part 20 (see FIG. 11(*a*)). Further, if the bent plate 38 is not positionally restricted in the replacement position, then an outer peripheral surface of the anti-separation section 36 is rotatably guided on the inner peripheral surface of the bearing part 20, thereby not allowing separation from the bearing part 20 (see FIG. 11(*b*)).

Further, the connector 43 is provided at a side of the second plate 30 opposite to the shaft member 32. The connector 43 is connected to the electric wire bundle connected to the drive motor. The connector 43 and the connector receptacle 19 are connected to each other, thereby collectively relaying supply of power and transmission/reception of signals in a single place.

Further, an engaging member 46, which includes an engaging claw 45 engaging to and disengaging from the rectangular aperture 17 of the engaging receptacle 16, is provided at the lower edge of the second plate 30. The engaging claw 45 is configured to advance and retract by pivoting a lever 47 to thereby engage to and disengage from the rectangular aperture 17. Thus, between the packaging unit 4 and the slide unit 8, the shaft member 32 is supported by the bearing parts 20, while the engaging claw 45 of the engaging member 46 engages to the rectangular aperture 17 of the engaging receptacle 16. That is, positioning is conducted at two places.

(1-3. Cart 2) The packaging unit 4 is replaced by using the cart shown in FIG. 1. The cart 2 includes: a loading table 48 movably supported by casters (not shown) provided at four corners of a lower surface of the cart; and an inverted U-shaped grip part 49 that projects from both opposed ends of a first lateral edge 48*a* of the loading table 48 and then extends upwardly.

The loading table 48 is a flat plate made from a metallic material. A first placing part 50, a second placing part 51 and a third placing part 52, which are made from a plastic material, are anchored to an upper surface of the loading table. The first placing part 50 has a rectangular shape in a plan view and has an indent 50*a* in the middle thereof. The first placing part is provided in a second lateral edge 48*b* opposite to the grip part 49. The shaft member 32 of the packaging unit 4 is placed in the first placing part 50. Specifically, the lower end of the second shaft section 37 is placed in the indent 50*a* of the first placing part 50, thereby preventing positional discrepancy therebetween. The second placing part 51 includes a flat portion 51*a* extending along the second lateral edge 48*b* and a ramp portion 51*b* gradually descending toward the third placing part 52. Further, the third placing part 52 has the same configuration as the second placing part 51. The third placing part includes a flat portion 52*a* and a ramp portion 52*b*. The ramp portion 52*b* gradually descends toward the second lateral edge 48*b*. With the above-described configuration associated with the second placing part 51 and the third placing part 52, the packaging unit 4, which is moved while being pivoted relative to the loading table 48, is smoothly placed on the flat portions 51*a*, 52*a* through the ramp portions 51*b*, 52*b*.

A position indicating piece 53 and a positioning pin 54 are provided at a side surface of the second lateral edge 48*b* of the loading table 48. The position identifying piece engages to the position indicating hole 10 formed in the bottom plate 12 of the slide unit 8. The positioning pin engages to the positioning hole 11 formed in the bottom plate 12. The position indicating piece 53 has a large width and is configured so that its protruding end portion has a width dimension gradually decreasing toward its tip to for easy insertion into the position indicating hole 10. The position indicating piece 53 engages to the position indicating hole 10 with little play. The positioning pin 54 has a pointing tip and has a projection dimension smaller than the position indicating piece 53. When the position indicating piece 53 is inserted into the position indicating hole 11 and is then positioned to some extent, the positioning pin 54 is inserted into the positioning hole 11. Then, the positioning pin 54 engages to the positioning hole 11, thereby accurately positioning the cart 2 in a desired position with respect to the device body 3.

Further, a first locking lever 56 and a second locking lever 57 that are pivoted by an operating lever 55 are provided in the loading table 48. The levers 56, 57 are connected through a shaft 58 to thereby pivot integrally. The operating lever 55 is coupled to one end of the shaft 58 projecting from a side surface of the first lateral edge 48*a*. The operating lever includes a pair of pedals 55*a*, 55*b* configured to be stepped on with a foot. Stepping on the pedal 55*a* of the pedals rotates the shaft 58 righthandedly (when viewed from the operating lever 55), while stepping on the pedal 55*b* of the pedals rotates the shaft lefthandedly (when viewed from the operating lever 55). The second locking lever 57 is configured to protrude and retract through a rectangular aperture 48*c* formed in the middle of the loading table 48 (specifically, between the second placing part 51 and the third placing part 52). The first locking lever 56 is coupled to the opposite end of the shaft 58 projecting from the side surface of the second lateral edge 48*b*. The first locking lever is configured to be positioned horizontally when the second locking lever 57 protrudes upwardly and to protrude upwardly when the second locking lever 57 is horizontally positioned.

(2. OPERATION) Next, descriptions will be provided on a replacement work of the packaging unit 4 in the medicine packaging device 1 configured as described above.

(2-1. Procedure of Removing Packaging Unit) First, as shown in FIG. 1, the cart 2 is located in front of the device body 3. Then, the position indicating piece 53 of the cart 2 is inserted to the position indicating hole 10 to roughly position the cart 2 relative to the device body 3. Thereafter, the cart 2 is further moved toward the device body 3. The positioning pin 54 of the cart 2 is then inserted to the positioning hole 11 to produce a predetermined engagement therebetween, thereby accurately positioning the cart 2 with respect to the device body 3.

At this time, the operating lever 55 is operated (the pedal 55*a* is stepped on) to pivot the first locking lever 56 and the second locking lever 57. Thus, the first locking lever 56 is allowed to engage to an engaging member (e.g., a stepped portion, an engaging piece, etc.) on the lower surface of the device body 3. Thus, the cart 2 is not permitted to move away from the device body 3 even if the grip part 49 is pulled in. Further, the second locking lever 57 is shifted to a retraction position where it does not protrude from the upper surface of the cart 2.

Figure 2:
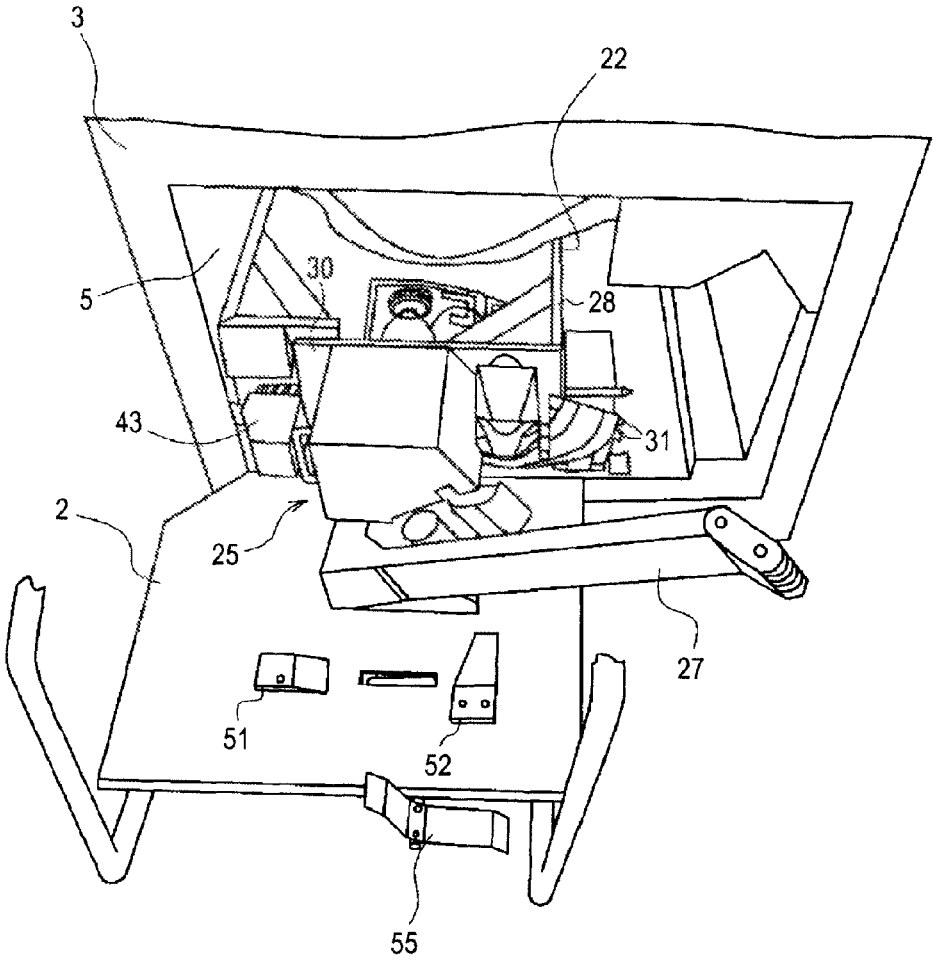
FIG. 2 is a perspective view showing that a slide unit and a packaging unit are drawn out to a drawn-out position from a state shown in FIG. 1.

Next, as shown in FIG. 2, the slide unit 8 with the packaging unit 4 placed thereon is drawn out from the device body 3. If the slide unit 8 is completely drawn out, then the shaft member 32 of the packaging unit 4 is placed in the first placing part 50. That is, the lower surface of the second shaft section 37 is positioned in the indent 50*a* of the first placing part 50 of the cart 2.

Figure 3:
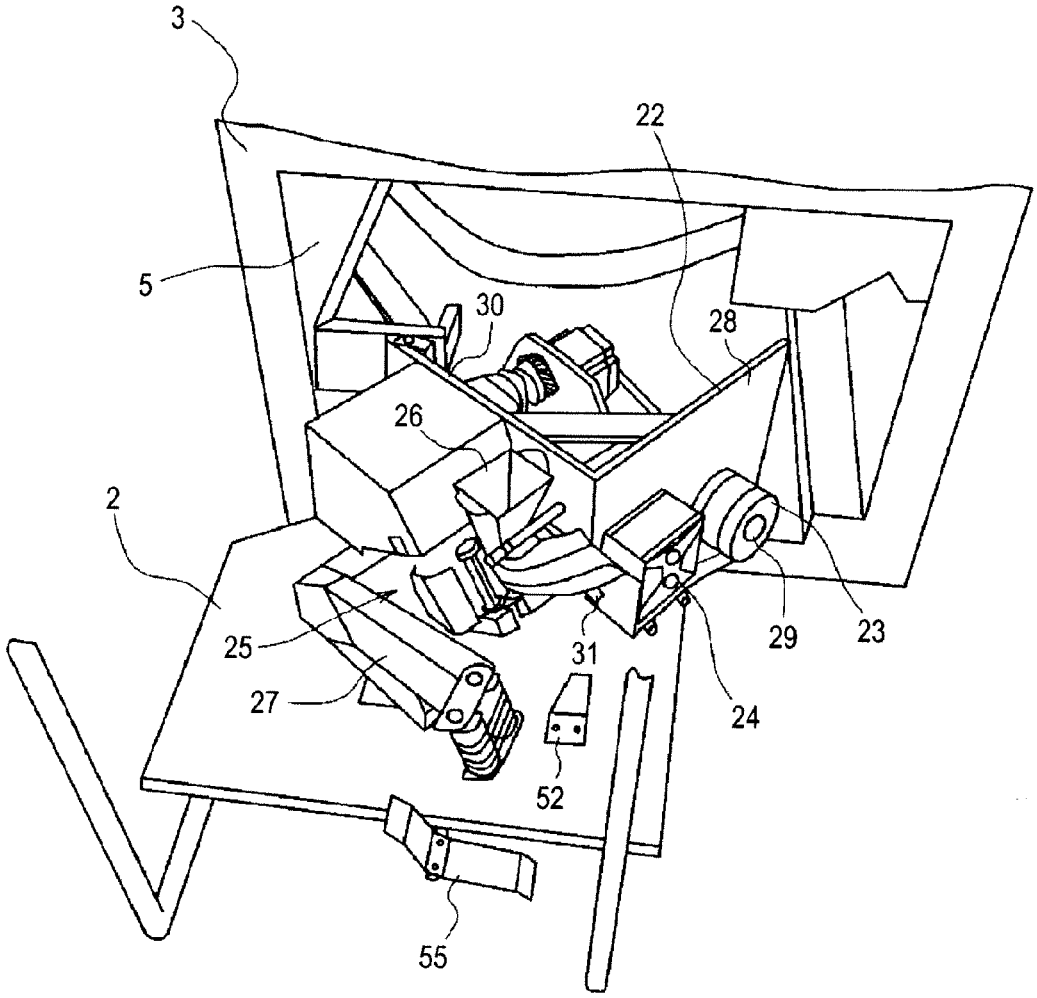
FIG. 3 is a perspective view showing that the packaging unit is pivoted from a state shown in FIG. 2.
Figure 4:
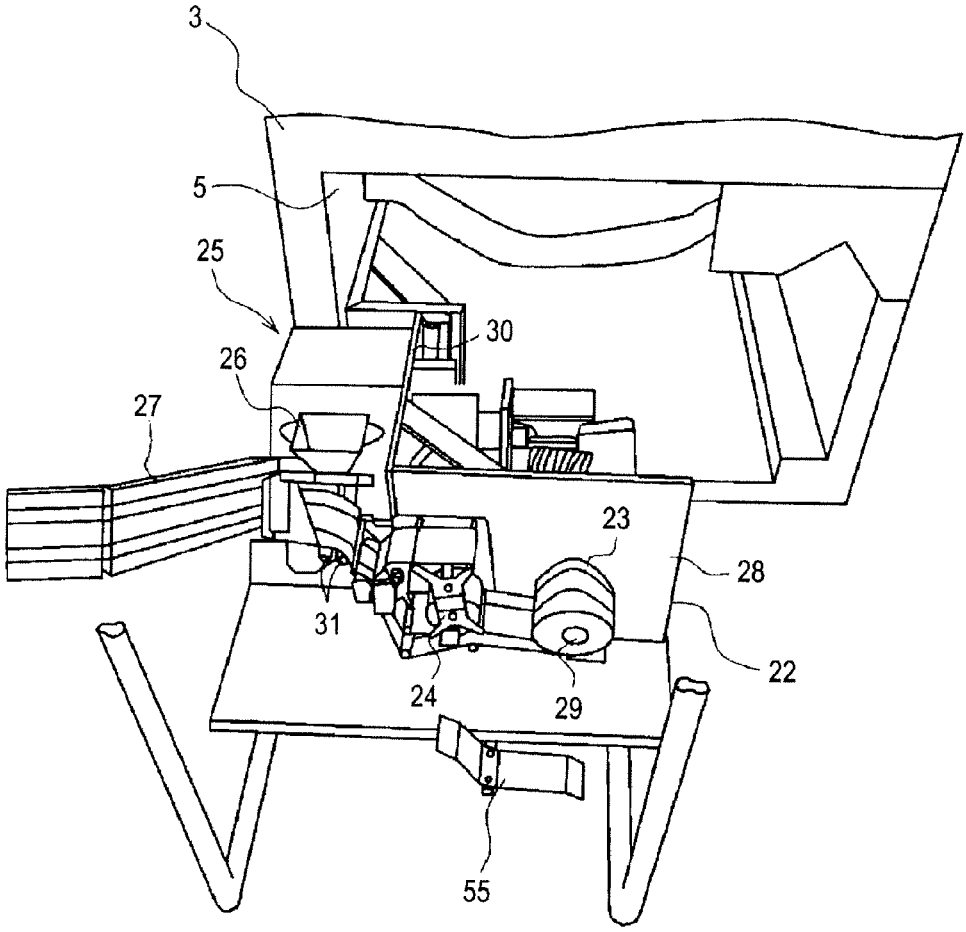
FIG. 4 is a perspective view showing that the packaging unit is pivoted to a replacement position from a state shown in FIG. 3.

Further, the lever 47 is pulled in and the engaging claw 45 is separated from the rectangular aperture 17 of the engaging receptacle 16, thereby releasing engagement therebetween and further allowing the packaging unit 4 to pivot with respect to the slide unit 8. Thereafter, as shown in FIG. 3, the packaging unit 4 is pivoted relative to the slide unit 8 about the shaft member 32 placed in the first placing part 50. By doing so, the bottom surface of the attaching member 22 is gradually guided by the ramp portion 51*b* of the second placing part 51 and the ramp portion 52*b* of the third placing part 52. Then, the packaging unit 4 is supported by the flat portions 51*a*, 52*a* of each of the placing parts 51, 52 at the end, as shown in FIG. 4.

Figure 11:
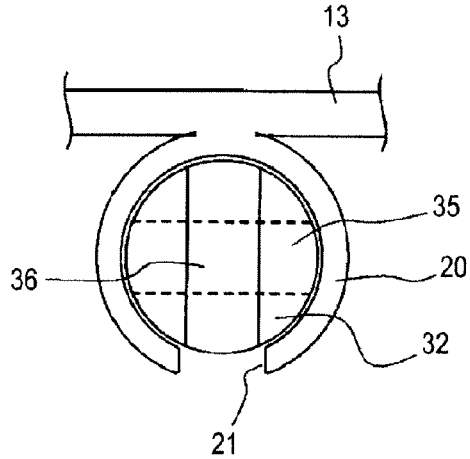
FIG. 11 is a fragmentary enlarged plan view showing a positional relationship between a shaft section and an anti-separation section of a shaft member of the packaging unit and a bearing part of the slide unit.
Figure 11:
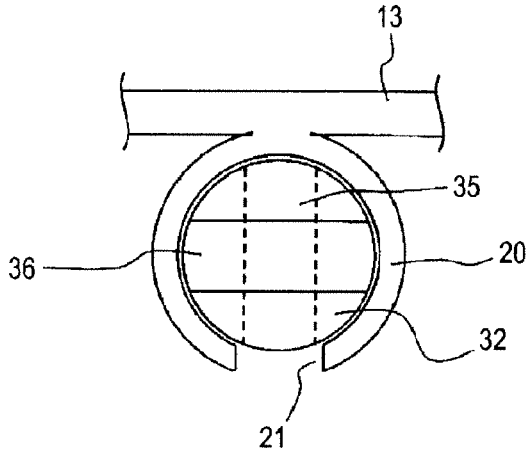
Figure 11:
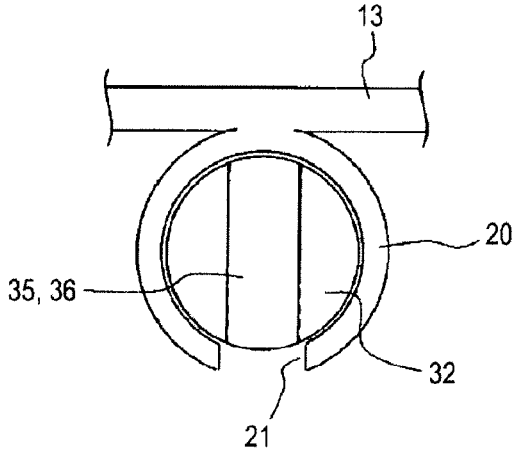

At such a state, the bent plate 38 is prevented from pivoting since the vertical portion of the stopper part 39 of the bent plate is in contact with a lateral surface of the first placing part 50. As a result, as shown in FIG. 11(*c*), the position of the cut surfaces of the anti-separation section 36 coincides with the position of the cut surfaces of the first shaft section 35 and the second shaft section 37, thereby permitting the shaft member 32 to attach to and detach from the bearing part 20.

As such, the packaging unit 4 can be simply transferred from the device body 3 to the cart 2 only by pivoting the packaging unit about the shaft member 32 supported by the bearing part 20. When the packaging unit 4 is pivoted, the shaft member 32 is supported in the first placing part 50 of the cart 2. Thus, the packaging unit can be smoothly transferred with little strength irrespective of its weight.

Thereafter, the operating lever 55 is operated. Then, the first locking lever 56 disengages from the engaging piece formed on the bottom surface of the device body 3. Further, the second locking lever 57 protrudes from the upper surface of the loading table 48 to engage to an engaging receptacle (not shown) formed on the lower surface of the placed packaging unit 4 (i.e., the lower surface of the first plate 28). Further, the connector 43 is separated from the connector receptacle 19. The supply of power to the packaging unit 4 and the transmission/reception of signals of the packaging unit are integrated to a connection between the connector 43 and the connector receptacle 19. Accordingly, only separating the connector 43 can cut off all the wiring, thereby providing high convenience.

Figure 5:
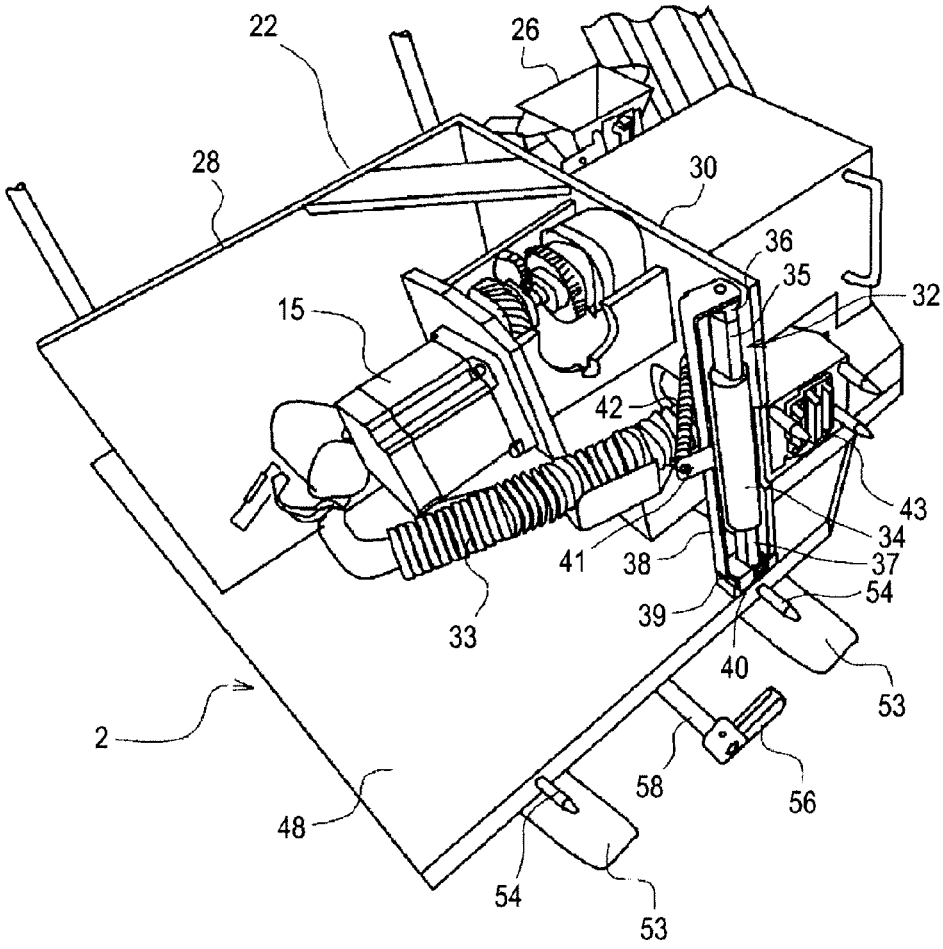
FIG. 5 is a perspective view showing the packaging unit placed on a cart.

Thereafter, the cart 2 is pulled in through the grip part 49 to separate the position indicating piece 53 and the positioning pin 54 from the position indicating hole 10 and the positioning hole 11, respectively. Then, as shown in FIG. 5, the placed packaging unit 4 is allowed to be carried. In such a case, the packaging unit 4 on the loading table 48 is positioned by means of the second locking lever 57. Accordingly, this provides safety since the packaging unit 4 is not out of position during carry.

(2-2. Procedure of Mounting Packaging Unit 4) Mounting the packaging unit 4 is performed through procedures opposite to those of the above-described removal.

That is, a new packaging unit 4 to be substituted is placed on another cart 2 in advance. Such a cart 2 is moved and then positioned with respect to the device body 3 using the position indicating piece 53 and the positioning pin 54. At this time, the slide unit 8 is drawn out and placed in the drawn-out position (or, the slide unit is already situated in the drawn-out position through the foregoing removal procedures). Next, the shaft member 32 of the packaging unit 4 is held in the bearing part 20 of the slide unit 8. Thereafter, the second locking lever 57 is pivoted downwardly to release engagement to the packaging unit 4 by stepping on the pedal 55*a*, while the first locking lever 56 is pivoted upwardly to position the cart 2 with respect to the device body 3. Subsequently, the packaging unit 4 is pivoted about the shaft member 32 supported by the bearing part 20. If the packaging unit is pivoted until the heat-sealing part 25 of the packaging unit 4 faces forward, then the engaging claw 45 of the engaging member 46 engages to the rectangular aperture 17 of the engaging receptacle 16. As a result, the packaging unit 4 is integrated to the slide unit 8. Thereafter, the packaging unit 4 is slid from the drawn-out position to a packaging position along with the slide unit 8. In the packaging position, the slide unit 8 may be positioned by a positioning means (not shown).

The present invention should not be limited to the foregoing embodiments. Various variations and modifications may be made within the subject matter of the following claims.

For example, while the slide unit 8 is configured to be slid in the frontward and backward directions of the device body 3, the slide unit may be configured to be slid in right and left directions in light of an installation location.

Further, while the packaging unit 4 is configured to be pivoted from the drawn-out position to the replacement position relative to the slide unit 8, the packaging unit may be configured to be moved to the replacement position by further sliding the packaging unit toward the cart 2.

Furthermore, the cutout portion 21 is formed in the bearing part 20. However, the bearing part may be made in a simple cylinder shape. Further, the first shaft section 35 or the second shaft section 36 of the shaft member 32 may be configured to extend from and retract to the lager-diameter section 34. Alternatively, the bearing part 20 may be configured such that a pair of half cylinders is pivotally connected to each other via a hinge to open and close. Moreover, the cart 2 may be positioned to the device body 3 by means of a magnet (including a solenoid).

The invention claimed is:

1. A medicine packaging device, comprising:

a device body having an accommodation space;

a slide unit reciprocally attached to the accommodation space of the device body; and a packaging unit removably attached to the slide unit, the packaging unit being allowed to package medicines with a packaging paper by moving the slide unit to a packaging position in the accommodation space, the packaging unit being moved to a drawn-out position drawn out from the packaging position, wherein the packaging unit is replaceable by being moved to a replacement position drawn out from the device body, and wherein the packaging unit is supported so as to be pivoted between the drawn-out position and the replacement position relative to the slide unit.

2. The medicine packaging device of claim 1, wherein the slide unit includes a bearing part with a cutout portion and the packaging unit includes a shaft member, and wherein the shaft member is cut with a width dimension permitting the shaft member to be inserted into the bearing part through the cutout portion in the replacement position, and after insertion, the shaft member not permitted to separate as an outer peripheral surface thereof is rotatably supported by rotating the shaft member to a position other than the replacement position.

3. The medicine packaging device of claim 2, wherein the shaft member includes a shaft section integrated to the packaging unit and an anti-separation section rotatable relative to the shaft section, wherein when the packaging unit is pivoted from the drawn-out position to the replacement position, the shaft section is attachable to and detachable from the bearing part through the cutout portion and the anti-separation section remains held in the bearing part, and wherein the shaft member is attachable to and detachable from the bearing part through the cutout portion by separately rotating the anti-separation section.

4. The medicine packaging device of claim 3, wherein the anti-separation section is integrated to a bent plate provided in an upper end of the shaft section and extending laterally and further downwardly, wherein a stopper part is integrated to a lower end of the bent plate, and wherein the stopper part prevents separation from the bearing part by contacting a placing part of a cart and hindering pivoting to hinder a rotation of the anti-separation section, the cart placing the packaging unit separated from the slide unit thereon.

5. The medicine packaging device of claim 1, wherein the packaging unit includes:

an attaching member;

a packaging roll removably attached to the attaching member, the packaging roll comprising the packaging paper wound therearound; and a sealing part attached to the attaching member, the sealing part placing medicines into the packaging paper unwound from the packaging roll and sealing the packaging paper to package the medicines.

6. A cart for replacing a packaging unit for use in a medicine packaging device, the medicine packaging device comprising:

a device body having an accommodation space at a lower portion;

a slide unit attached to the accommodation space of the device body to be slidable in frontward and rearward directions; and a packaging unit removably attached to the slide unit, the packaging unit being allowed to package medicines with a packaging paper by moving the slide unit to a packaging position rearward of the device body, the packaging unit being moved to a drawn-out position frontward of the device body, the packaging unit being replaceable by being moved to a replacement position drawn out frontward from the device body, the cart comprising a loading table having a placement surface located substantially at the same height as a bottom surface constituting the accommodation space of the device body, the loading table includes:

a positioning part relative to the device body; and a placing part, wherein the packaging unit is placed on the placing part by drawing out the slide unit to the drawn-out position and moving the packaging unit from the drawn-out position to the replacement position as positioned by the positioning part, wherein the slide unit includes a bearing part with a cutout portion and the packaging unit includes a shaft member, wherein the shaft member is cut with a width dimension permitting the shaft member to be inserted to the bearing part through the cutout portion in the replacement position, and after insertion, the shaft member not permitted to separate as an outer peripheral surface thereof is rotatably supported by rotating the shaft member to a position other than the replacement position, wherein the shaft member includes a shaft section integrated to the packaging unit and an anti-separation section rotatable relative to the shaft section, wherein the anti-separation section is integrated to a bent plate provided in an upper end of the shaft section and extending laterally and further downwardly, wherein a stopper part is integrated to a lower end of the bent plate, and wherein the stopper part prevents separation from the bearing part by contacting the placing part of the loading table and hindering pivoting to hinder a rotation of the anti-separation section, the loading table placing the packaging unit separated from the slide unit thereon.

* * * * *